US005343593A

United States Patent [19]

Fayngersh

[11] Patent Number: 5,343,593

[45] Date of Patent: Sep. 6, 1994

[54] DOOR CLOSER

[75] Inventor: Zakhary Fayngersh, West Hartford, Conn.

[73] Assignee: Emhart Inc., Newark, Del.

[21] Appl. No.: 21,995

[22] Filed: Feb. 24, 1993

[51] Int. Cl.[5] ..... E05F 3/00

[52] U.S. Cl. ..... 16/52; 16/51; 16/62

[58] Field of Search ..... 16/51, DIG. 21, 62, 16/52

[56] References Cited

U.S. PATENT DOCUMENTS

| | | | |
|---|---|---|---|
| 1,770,250 | 7/1930 | Norton . | |
| 2,586,135 | 10/1949 | Woodruff . | |
| 2,701,383 | 4/1950 | Billeter . | |
| 2,723,416 | 11/1955 | Schlage . | |
| 3,574,886 | 4/1971 | Solovieff . | |
| 4,185,356 | 1/1980 | Kuivalainen et al. . | |
| 4,285,094 | 8/1981 | Levings, Jr. | 16/DIG. 21 |
| 4,573,238 | 3/1986 | Phillips | 16/DIG. 21 |

*Primary Examiner*—Carmine Cuda
*Attorney, Agent, or Firm*—Spencer T. Smith

[57] ABSTRACT

A door closer having a housing defining a fluid containing chamber and a fluid reservoir and including a piston supported in the chamber for movement in one and an opposite direction in response to respective opening and closing movements of a door. A first fluid passageway defined by the housing provides communication between the chamber and the reservoir for the free passage of fluid from the chamber to the reservoir in response to initial movement of the piston in the one direction. A second fluid passageway spaced in the one direction from the first fluid passageway contains a ball check valve spring biased to closed position for resisting the flow of fluid from the chamber through the second passageway to the reservoir. The valve is threadably adjustable relative to the housing to regulate the resistance to fluid flow. A third fluid passageway spaced from the first passageway and disposed in bypassing relation to the second fluid passageway includes an adjustable metering orifice and provides a free flow path from the chamber to the reservoir. The size of the metering orifice is also adjusted by threadably adjusting the valve relative to the housing.

3 Claims, 2 Drawing Sheets

DOOR CLOSER

BACKGROUND OF THE INVENTION

This invention relates in general to door closing devices and deals more particularly with an improved door closer assembly of the type which includes a door closer and an articulated closer arm assembly. A typical door closer of the aforedescribed general type is connected between a door and its frame to exert closing force on the door when the door is released in an open position.

The present invention is particularly concerned with improvements in a door closer of the aforedescribed general type which includes a back check mechanism of an intensity responsive type for controlling movement of a door as it approaches a fully opened position. Such a device operates in response to the intensity of fluid pressure within a door closer and is generally effective to control an attempt to violently or abusively open a door in a manner which could cause injury to a person in the path of the door or result in damage to the door itself and/or its supporting structure A substantial change in ambient temperature which causes a corresponding change in the viscosity of fluid within the door closer can substantially alter the operational characteristics of a door closer. A back check device of the type hereinbefore discussed has the advantage of being generally temperature responsive. A properly designed intensity responsive back check device can be adjusted to substantially overcome this problem.

Although such a back check device affords substantial advantage it has the disadvantages of being intensity responsive throughout its entire adjustable range of operation. Thus, the device tends to offer a somewhat greater resistance force to the normal opening of a door than might otherwise be desired. The present invention is concerned with this problem.

SUMMARY OF THE INVENTION

In accordance with the present invention a door closer is provided having a housing defining a fluid containing chamber and a fluid reservoir and a piston supported in the chamber for movement in one and an opposite direction in response to respective opening and closing movements of a door. The door closer further includes first fluid passageway means for the free passage of fluid from the chamber to the reservoir in response to initial movement of the piston in the one direction and second fluid passageway means spaced in the one direction from the first fluid passageway means and communicating with the chamber and the reservoir. Valve means in the second passageway means yieldably resists flow of fluid from the chamber to the reservoir through the second passageway means. A regulating means is provided for adjusting the yieldable resistance of the valve means. A third fluid passageway means spaced in the one direction from the first fluid passageway means is disposed in bypassing relation to the second fluid passageway means for the free flow of fluid from the chamber to the reservoir.

DETAILED DESCRIPTION OF THE PREFERRED EMBODIMENTS

Figure 1:
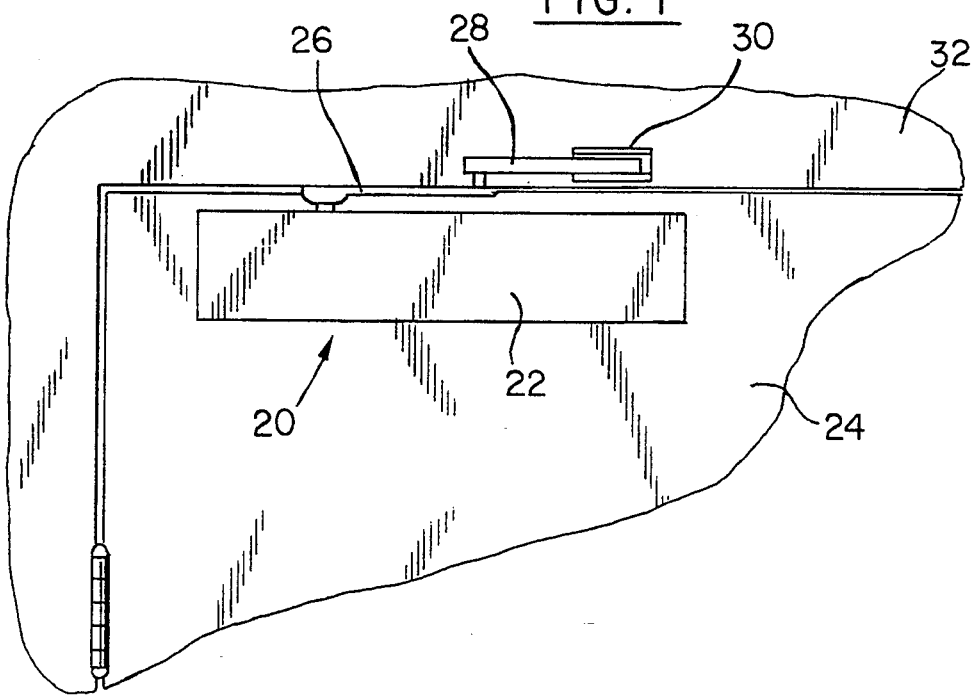
FIG. 1 is a fragmentary front elevational view showing a door closer in assembly with a door and related door frame.

Referring now to the drawings, a preferred embodiment of the invention includes a door closer 20 which is enclosed within a cover 22 mounted in a typical manner to the upper surface of a heavy duty door such as the door 24. One end of a first actuator arm 26 is coupled to the door closer 20 and is connected for pivoting movement to a second actuator arm 28. The other end of arm 28 is connected for pivoting movement to a bracket 30 which is mounted on a door frame 32 associated with door 24.

Figure 2:
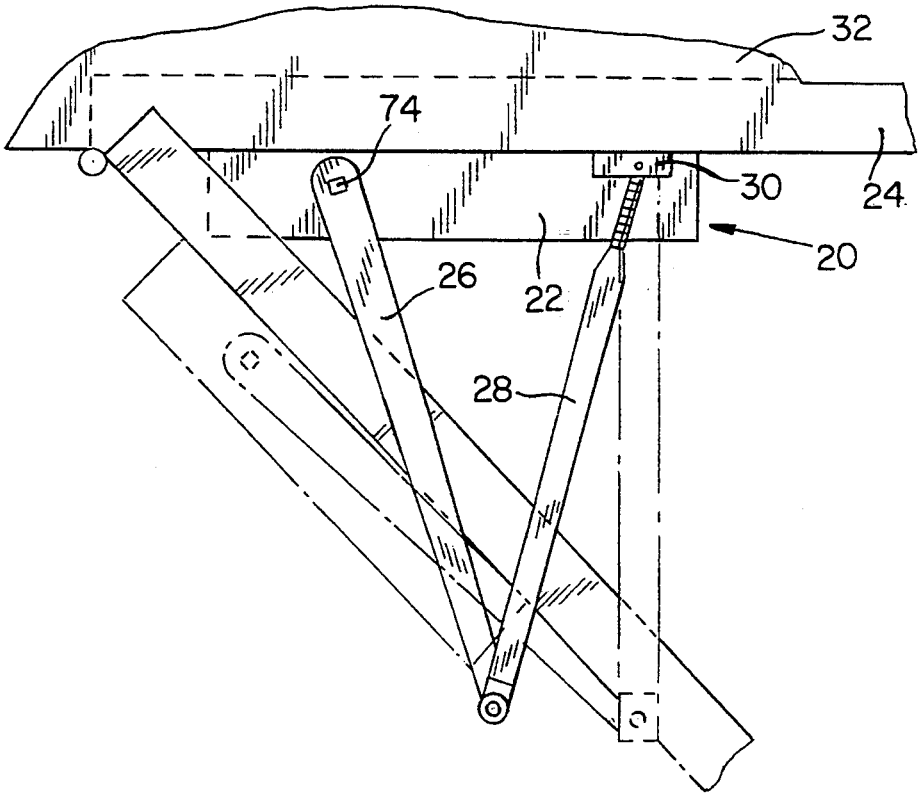
FIG. 2 is a top view of the door closer of FIG. 1 showing the door in a closed position and in an opening position.

Referring to FIG. 2, as door 24 is opened, or closed, arm 28 pivots with respect to bracket 30 and causes pivotal movement of arm 26 which is coupled to the door closer 20. As door 24 is opened, a mechanism within the door closer 20 operates to provide opposition to the rapid opening of the door and eventually establishes a back checking resistance when the door attains an angular opening of sixty to seventy-five degrees, for example. It then becomes increasingly more difficult to open the door to a full open position. In effect, door closer 20 provides a back resistance to violent opening as the door approaches the aforesaid angular positions to establish a "back check" condition as if there were a physical impediment in the path of the door which must be overcome to further open the door. This feature is useful, for example, where the rapid opening of such a door could result in serious injury to a person in the path of the door or could cause serious and costly damage to the door itself or its supporting structure.

Figure 3:
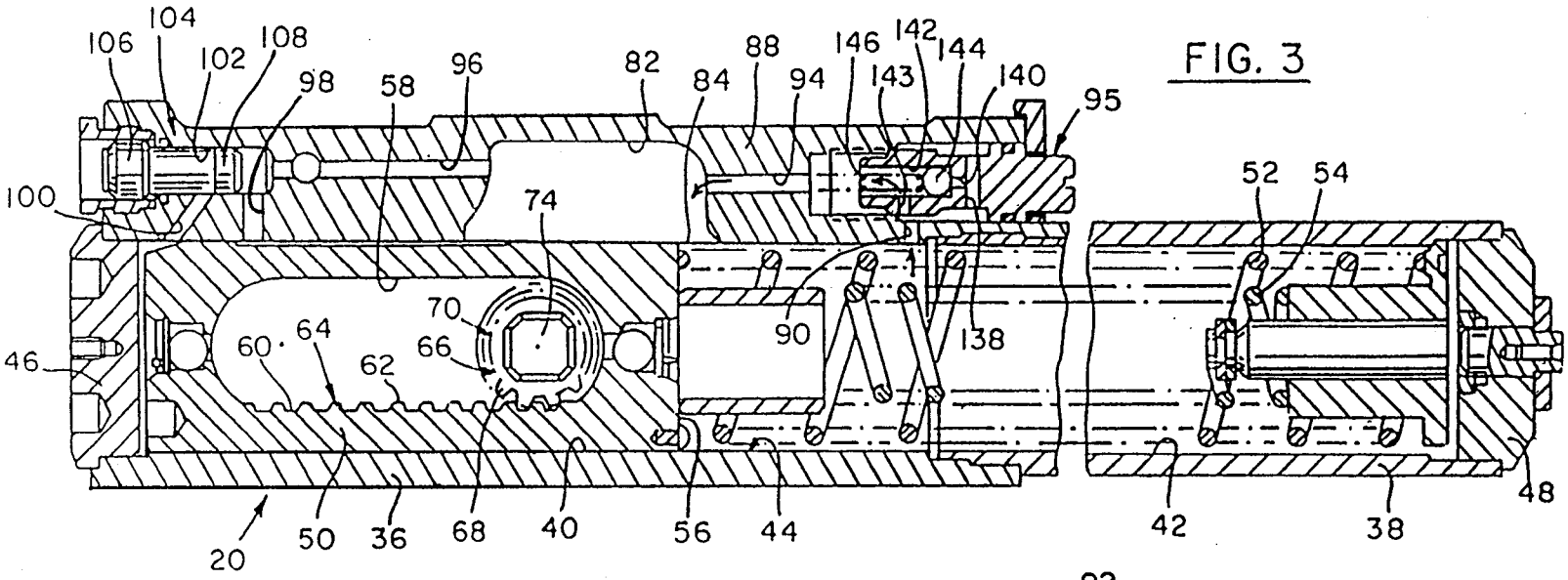
FIG. 3 is a horizontal axial sectional view through a door closer embodying certain principles of the invention.

As shown in FIG. 3 a preferred embodiment of the invention includes the door closer 20 with a housing formed by a cylinder 36 and a spring tube 38 threadedly joined together. The cylinder 36 and the spring tube 38 are assembled in axial alignment so that a cylinder opening 40 and a tube opening 42, respectively, join to form a cylindrical chamber 44. A first cap 46 located over one end of cylinder 36 and a second cap 48 located over one end of spring tube 38 enclose chamber 44.

A piston 50 disposed within the chamber 44 is supported for movement in one and an opposite direction within the chamber in response to respective opening and closing movements of the door. The piston is located normally in a first position within a first portion of chamber 44 generally defined by about two-thirds of opening 40 of cylinder 36. A pair of compression springs 52 and 54 are captured within chamber 44 and act between an inward end 56 of the piston 50 and the tube cap 48. Springs 52 and 54 are located in a second portion of chamber 44 defined by the remaining one-third of cylinder opening 40 and the entire tube opening 42. Further, the second portion of chamber 44 which includes springs 52 and 54 is typically filled with a fluid such as oil which is not readily compressible.

Piston 50 is formed with an elongated opening 58 which is enclosed at its axial opposite ends but is open from side to side. An elongated wall 60 of opening 58 has teeth 62 which extend inwardly of the opening to form a rack 64. A driving pinion 66 having teeth 68 about its periphery is located within opening 58 at one end thereof as illustrated in FIG. 3. The teeth on the pinion meshing engage with the teeth 62 on the rack 64. The pinion shaft projects from and beyond the upper and lower walls of the closer housing and has non-circular end portions, preferably square, as indicated at 74 for selective connection to an associated actuator arm such as the arm 26 shown in FIGS. 1 and 2.

Further referring to FIG. 3, a reservoir 82 is formed at the side of the housing and extends from the top to the bottom of cylinder 36 and communicates with chamber 44 through an opening or first fluid passageway 84.

Referring again to FIG. 3, other fluid flow passages 96, 98 and 100 are formed in the housing provide communication between chamber 44 and reservoir 82. A valve 104 located in a valve chamber 102 is threadedly adjustable to control the speed of door closing at the time of latching.

In accordance with the present invention the door closer 20 includes an improved adjustable back check mechanism for controlling a sudden final opening movement of a door as, for example, when a door is opened to an angular position of from 60 to 75 degrees. The improved back check mechanism essentially comprises an adjustable pressure relief or ball check valve for relieving pressure within the second portion of the chamber by venting fluid to the reservoir 82 as the piston 50 advances within the second portion in response to a rapid increase in the rate of rotation of the pinion 66 connected to the articulated actuator arms 26 and 28 caused by a violent opening of the door, for example.

Figure 4:
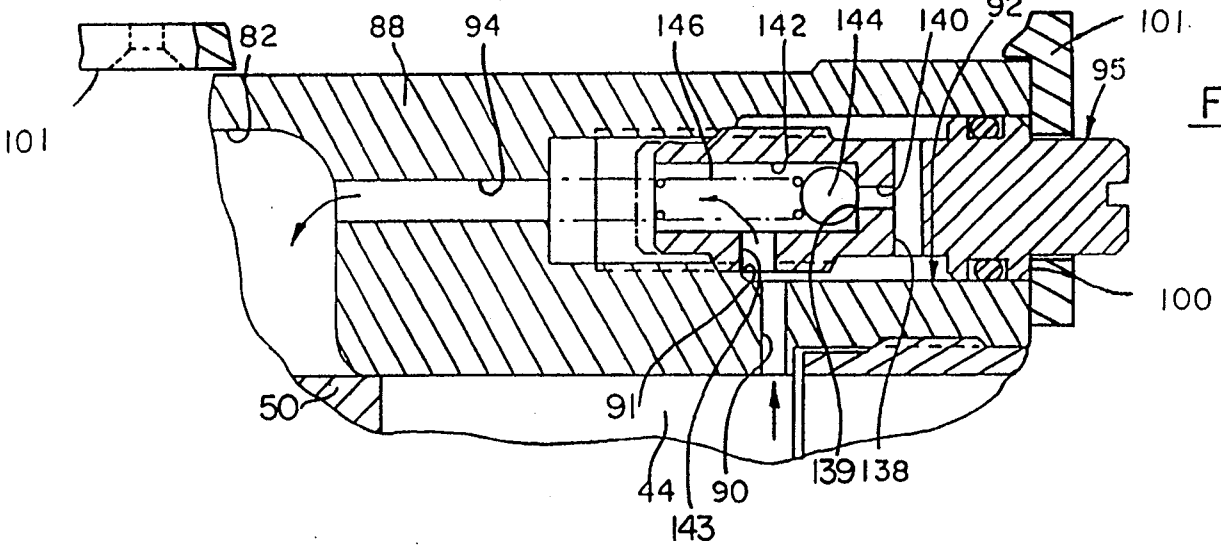
FIG. 4 is a somewhat enlarged fragmentary sectional view of the door closer of FIG. 3.

The valve assembly, best shown in FIG. 4, essentially comprises a stepped cylindrical valve chamber 92 opening outwardly through a portion of the housing indicated at 88 and having a diametrically enlarged smooth walled outer end portion. The inner end portion of the valve chamber is internally threaded substantially as shown. A fluid flow passageway 94 communicates between the inner end of the valve chamber 92 and the reservoir 82. Another fluid flow passageway 90 communicates between the second portion of the chamber 44 and the diametrically enlarged outer end portion of the valve chamber 92.

A generally cylindrical valve element indicated generally at 95 and having an external thread portion spaced from its inner end is threadably received within the valve chamber 92. The valve element 95 has a cylindrical bore 142 opening through its inner end. A generally radially disposed fluid passageway 143 formed in the valve element 95 communicates with the bore 142 and opens outwardly through the threaded portion of the valve element. Another fluid passageway 138 extends transversely through the valve element 95 outwardly of the bore 142. Still another fluid passageway 140 formed in the valve element opens coaxially into the bore 142 and communicates with the transverse passageway 138, substantially as shown.

The effective cross-sectional area at the outer end of the passageway 143 may be varied by threading the valve element 95 into or out of the valve chamber 92 between the broken line and full line positions shown in FIG. 4. Thus, the passageway outer end portion indicated at 91 in FIG. 4 comprises an adjustable metering orifice for regulating the flow of fluid into and through the passageway 143.

The ball check mechanism includes a spherical ball 144 for engaging a valve seat 139 at the inner end of the passageway 140. A spring 146 acts between the inner end of the valve chamber 92 and the ball 144 to urge the ball toward and maintain it in seating engagement with the valve seat 139 to normally provide a closure for the passageway 140.

An O-ring received within an annular groove in the outer end portion of the valve element 95 cooperates in sealing feeling engagement with the smooth walled outer end of the valve chamber 92. An abutment surface 100 on the outer end of the valve element 95 is engagable with a mounting bracket 101 mounted in fixed position to the closer housing to arrest further outward movement of the valve element 95 when the metering orifice 91 reaches its fully open or maximum fluid flow condition. A slot in the outer end of the valve element facilitates screw driver adjustment.

When the door 24 is closed the piston is in substantially the position in which it appears in FIG. 3. The opening of the door produces counterclockwise rotation of the pinion 66 which advances the piston driving it in the direction of the end cap 48 against the biasing force of the springs 52 and 54. During the initial opening movement of the door the advancing piston 50 forces fluid out of the chamber 44 through the passageway 84 and directly into the reservoir 82. Due to the direct unobstructed flow path to the reservoir through the passageway 84 no fluid resistance to the opening movement of the door is encountered during this initial movement of the piston. As the piston advances the opening 84 is closed by the piston 50.

When the piston 50 advances to its position shown in FIG. 4 fluid is thereafter constrained to flow from the chamber 44 through the passageways 90, 142, 143 and 94 to the reservoir. The flow path defined by the latter passageways being somewhat more restrictive than the direct flow path 84 to the reservoir it will be apparent that some additional resistance to further opening of the door may be encountered. If the door is being opened in a normal manner this increased resistance will be relatively slight. Since the unobstructed flow path previously described offers the flow path of least resistance from the chamber 44 to the reservoir 82 the ball check valve mechanism will normally remain in its closed position, the ball 144 being biased into seating engagement with the valve seat 139.

The substantially unobstructed flow passageway through the valve mechanism hereinbefore described is incapable of responding to a sudden increase in fluid pressure within the chamber 44. If a sudden force is applied to the door to open it in a violent manner the ball 144 will unseat against the biasing force of the spring 146 allowing passage of fluid from the chamber 44 through the fluid passageways 138 and 140 past the ball 144 and into the bore 142 and to the chamber through the passageway 94 to the reservoir 82, whereby the opening force will be dampened without risk of damage to the door or its associated supporting structure or injury to a person who may be standing in the path of the door.

It will now be apparent that threadably adjusting the valve element 95 inwardly toward the inner end of the valve chamber reduces the size of the metering orifice 91 at the outer end of the passageway 143 and simultaneously increases the biasing force exerting upon the ball 144 by the spring 146 thereby increasing the operative resistance of the ball check mechanism. Reverse adjustment of the valve element 95 decrease the biasing force of the spring 146 acting upon the ball 144 and also increases the effective size of the metering orifice 91 whereby resistance to normal opening force applied to the door decreases. As previously noted any adjustment of the metering orifice 91 will be accompanied by a slight adjustment of the spring pressure in the ball check valve. However, only a small amount of axial valve element displacement is required to produce a significant change in the size of the metering orifice 91, therefore it will be apparent that the accompanying change in spring pressure acting upon the ball 144 will be substantially insignificant.

Although the unobstructed flow passageway does not render the door closer 20 temperature response any substantial increase in ambient temperature which results in a substantial increase in the viscosity of the fluid within the chamber 44 will be compensated for by the ball check mechanism in a manner well known in the art.

The valve element 95 may be adjusted by threading it into and toward the inner end of the valve chamber 92 to fully cut-off or close the fluid passageway 143. When the latter adjustment is made only the intensity back check valve is operable which results in some increase in the applied force required to open the door in a normal manner.

I claim:

1. A door closer to be secured to a door which can be opened by applying an opening force which, if larger than a selected force when the door is opened beyond a predetermined angle, could subject the door to damage comprising a closer housing including a cylindrical chamber having opposed ends, a cylindrical piston located proximate one of said ends and slidably displaceable within said cylindrical chamber and defining with said other end a variable volume for containing a non-compressible liquid, coaxial compression spring means located within said volume, means for displacing said cylindrical piston as said door is opened to compress said spring means and to impart a pressure to the contained liquid, means operable when the door has been displaced beyond the predetermined angle to release liquid from said variable volume including a cylindrical housing open at one end and closed at the other end, an inlet conduit in said closed end, a sealing ball, second spring means for urging said sealing ball against said inlet conduit to prevent flow of liquid therethrough into said cylindrical housing below a selected pressure, conduit means for connecting said variable volume and said inlet conduit, and a second conduit in said cylindrical housing downstream of said sealing ball, said second conduit communicating with said conduit means so that when the pressure of the liquid is below a selected pressure, the liquid will be released through said second conduit and when the pressure is above said selected pressure, the liquid will be conjointly released through said inlet conduit and said second conduit.

2. A door closer according to claim 1, wherein said cylindrical housing has a threaded portion proximate said open end, said closer housing has a threaded bore for receiving said cylindrical housing and said conduit means being selectively configured so that said second conduit can be progressively restricted by threadedly advancing said cylindrical housing.

3. A door closer according to claim 2, wherein said second spring means will be compressed as said cylindrical housing is advanced.

* * * * *